US009677356B2

(12) United States Patent
Rochen et al.

(10) Patent No.: US 9,677,356 B2
(45) Date of Patent: Jun. 13, 2017

(54) INSERT UNITS FOR NON-METALLIC SLIPS ORIENTED NORMAL TO CONE FACE

(71) Applicant: Weatherford/Lamb, Inc., Houston, TX (US)

(72) Inventors: James Alan Rochen, Waller, TX (US); Shawn J. Treadaway, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 248 days.

(21) Appl. No.: 14/446,642

(22) Filed: Jul. 30, 2014

(65) Prior Publication Data

US 2015/0027737 A1 Jan. 29, 2015

Related U.S. Application Data

(63) Continuation-in-part of application No. 14/039,032, filed on Sep. 27, 2013.

(60) Provisional application No. 61/861,302, filed on Aug. 1, 2013, provisional application No. 61/708,597, filed on Oct. 1, 2012, provisional application No. 61/735,487, filed on Dec. 10, 2012.

(51) Int. Cl.
*E21B 23/01* (2006.01)
*E21B 33/129* (2006.01)

(52) U.S. Cl.
CPC ..... *E21B 23/01* (2013.01); *E21B 33/1291* (2013.01); *Y10T 29/49826* (2015.01)

(58) Field of Classification Search
CPC ..... E21B 23/01; E21B 33/1291
See application file for complete search history.

(56) References Cited

U.S. PATENT DOCUMENTS 2,691,418 A 10/1954 Connolly
4,823,919 A * 4/1989 Hayatdavoudi ..... E21B 19/10 188/244
4,941,532 A 7/1990 Hurt et al.
5,131,468 A 7/1992 Lane et al.
5,271,468 A 12/1993 Streich et al.
5,701,959 A 12/1997 Hushbeck et al.
5,984,007 A 11/1999 Yuan et al.
(Continued)

OTHER PUBLICATIONS

First Examination Report in counterpart Australian Appl. 2013237721, dated Apr. 10, 2015.
(Continued)

*Primary Examiner* — Cathleen Hutchins
*Assistant Examiner* — Ronald Runyan
(74) *Attorney, Agent, or Firm* — Blank Rome LLP

(57) ABSTRACT

A slip assembly for a downhole tool, such as a bridge plug, has a slip body and at least one insert unit with a base and one or more inserts. The slip body has an incline at one end that interfaces with an inclined surface of a cone. As this occurs, the slip body is pushed away from the tool's mandrel against a surrounding casing wall. The insert unit is disposed in the slip body with the base oriented at an angle relative to the incline, and with the one or more inerts extending from the base. In particular, the base can be disposed at or parallel to the incline, and the one or more inserts with less surface area than the base can extend perpendicular to the inline for the insert's distal ends to engage a surrounding wall of casing or the like.

23 Claims, 9 Drawing Sheets

(56) References Cited

U.S. PATENT DOCUMENTS

| | | | | |
|---|---|---|---|---|
| 6,167,963 | B1 | 1/2001 | McMahan et al. | |
| 6,564,871 | B1 * | 5/2003 | Roberts | E21B 7/06 166/117.6 |
| 6,793,022 | B2 | 9/2004 | Vick et al. | |
| 6,820,705 | B2 * | 11/2004 | Baugh | E21B 19/10 166/382 |
| 6,976,534 | B2 | 12/2005 | Sutton et al. | |
| 7,124,831 | B2 | 10/2006 | Turley et al. | |
| 7,424,909 | B2 | 9/2008 | Roberts et al. | |
| 7,779,906 | B2 | 8/2010 | Porter et al. | |
| 7,779,927 | B2 | 8/2010 | Turley et al. | |
| 8,047,279 | B2 | 11/2011 | Barlow et al. | |
| 8,069,918 | B2 | 12/2011 | Zimmerman et al. | |
| 8,113,276 | B2 | 2/2012 | Greenlee et al. | |
| 2003/0150607 | A1 * | 8/2003 | Roberts | E21B 33/1293 166/118 |
| 2003/0226668 | A1 | 12/2003 | Zimmerman et al. | |
| 2009/0084516 | A1 * | 4/2009 | Fothergill | B22D 19/00 164/110 |
| 2012/0097384 | A1 | 4/2012 | Valencia et al. | |

OTHER PUBLICATIONS

First Office Action in counterpart Canadian Appl. 2,828,491, dated Mar. 5, 2015.

Weatherford, "WRP Bridge Plug," obtained from www.weatherford.com copyright 2007, brochure No. 2640.00, 3 pages.

Weatherford, "Packer Service Tools," obtained from www.weatherford.com copyright 2010, brochure No. 1205.01, 90 pages.

Weatherford, "FracGuard Composite Plugs," obtained from www.weatherford.com, copyright 2004, brochure No. 744.00, 8 pages.

First Office Action in counterpart Canadian Appl. 2,858,271, dated Sep. 14, 2015.

Extended Search Report in counterpart EP Appl. 14179595.5, dated Dec. 4, 2015.

First Examination Report in counterpart Australian Appl. 2014208263, dated Jun. 22, 2015.

* cited by examiner

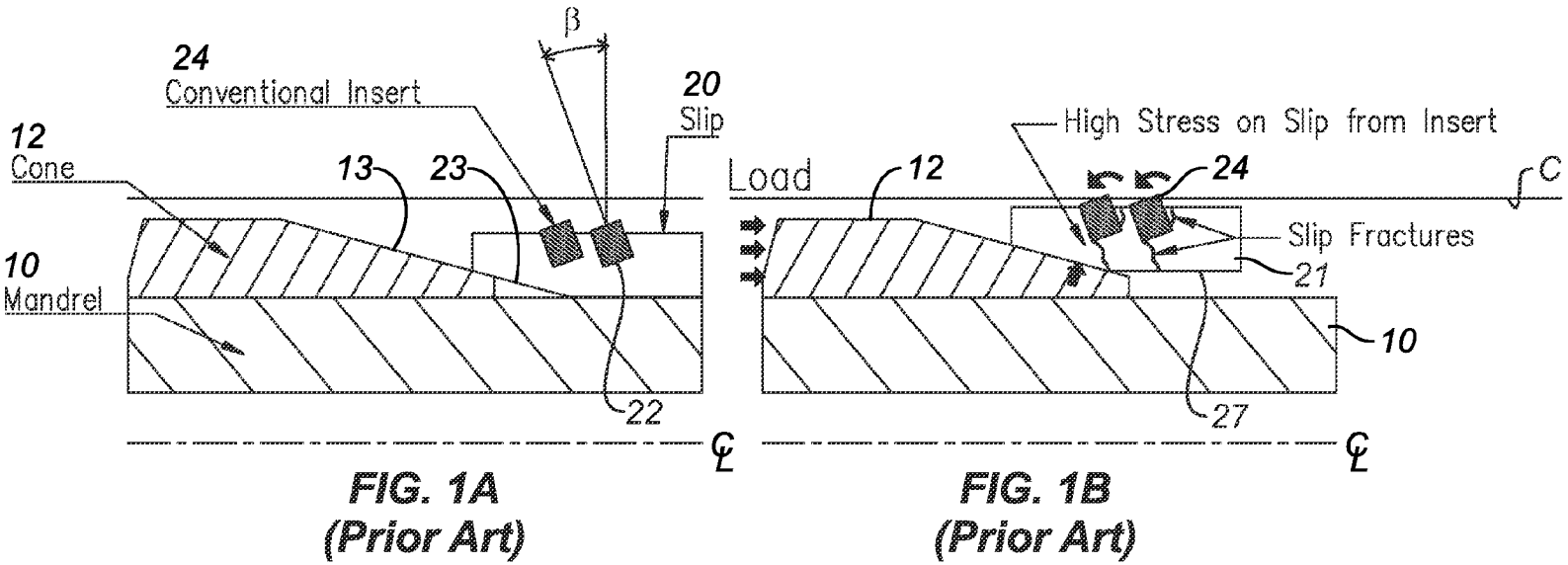
FIG. 1A
(Prior Art)
FIG. 1B
(Prior Art)
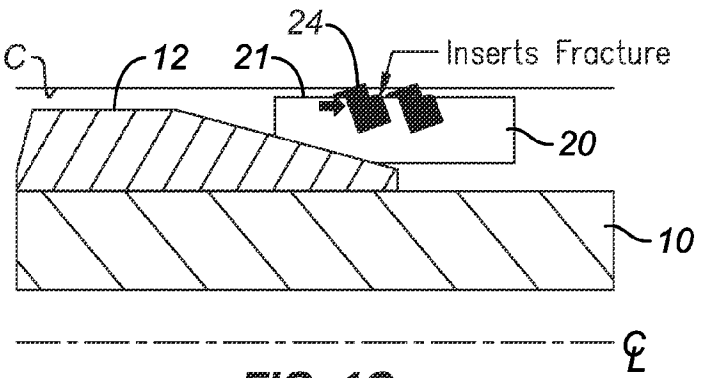
FIG. 1C
(Prior Art)

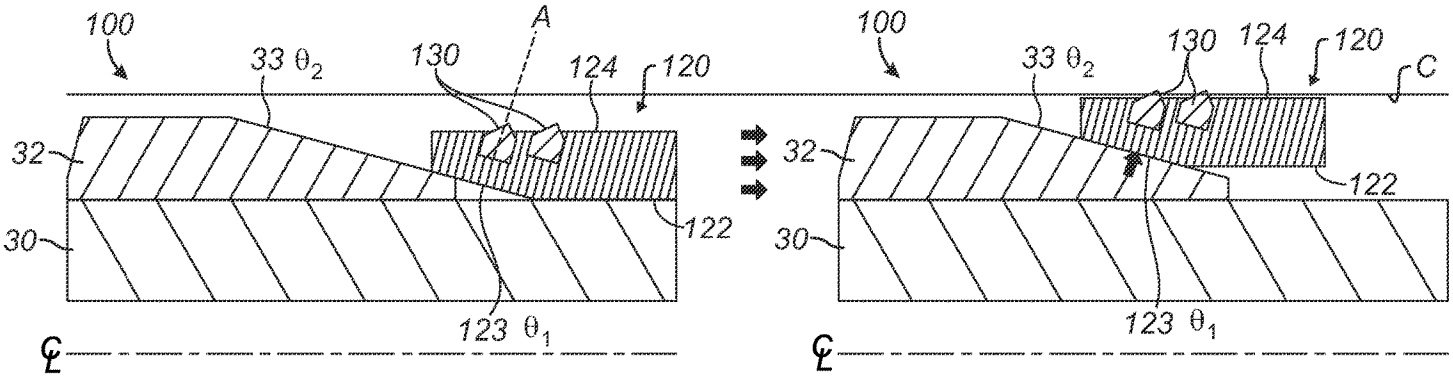
FIG. 4A
FIG. 4B
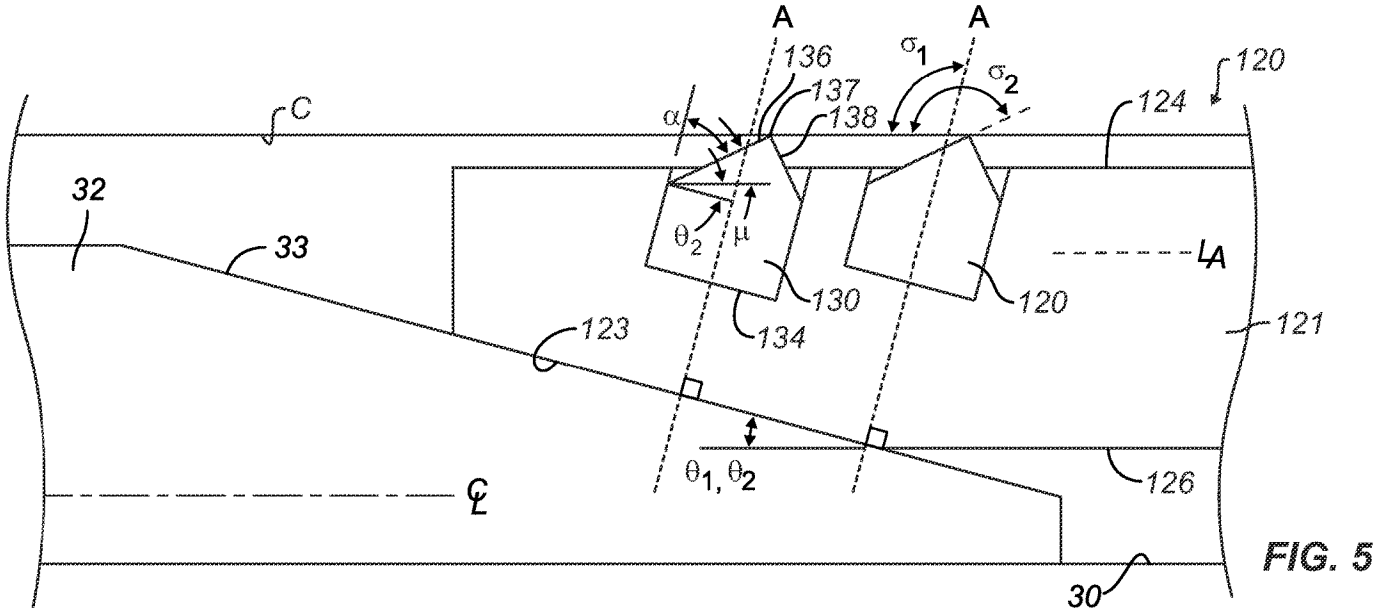
FIG. 5

INSERT UNITS FOR NON-METALLIC SLIPS ORIENTED NORMAL TO CONE FACE

CROSS-REFERENCE TO RELATED APPLICATIONS

This application claims the benefit of U.S. Provisional application 61/861,302, filed 1 Aug. 2013, and is a continuation-in-part of U.S. application Ser. No. 14/039,032, filed 27 Sep. 2013, which claims the benefit of U.S. Provisional application 61/708,597, filed on 1 Oct. 2012, and U.S. Provisional application 61/735,487, filed on 10 Dec. 2012, all of which are incorporated herein by reference in their entireties.

BACKGROUND OF THE DISCLOSURE

Slips are used for various downhole tools, such as bridge plugs and packers. The slips can have inserts or buttons to grip the inner wall of a casing or tubular. Examples of downhole tools with slips and inserts are disclosed in U.S. Pat. Nos. 6,976,534 and 8,047,279. Inserts for slips are typically made from cast or forged metal, which is then machined and heat-treated to the proper engineering specifications according to conventional practices.

Inserts for slips on metallic and non-metallic tools must be able to engage with the casing to stop the tool from moving during operation. On non-metallic tools, the inserts can cause the non-metallic slips to fail when increased loads are applied. Of course, when the slip fails, it disengages from the casing.

When conventional inserts are used in non-metallic slips, they are arranged and oriented as shown in FIG. 1A. The slip 20 is disposed adjacent a mandrel 10 of a downhole tool, such as a bridge plug, packer, or the like. The slip 20 moves away from the mandrel 10 and engages against a surrounding tubular or casing wall when the slip 20 and a cone 12 are moved toward one another. Either the slip 20 is pushed against the ramped surface 13 of the cone 12, the cone 12 is pushed under the incline 23 of the slip 20, or both.

As shown in FIG. 1A, the pockets 22 and the inserts 24 disposed in those pockets 22 intersect the slip 20 at an acute bite angle β with respect to a line perpendicular to the slip's surface 21. Thus, the conventional arrangement places the inserts 24 at an angle β toward the ramped surface 13 of the cone 12 and the incline 23 of the slip 20. The angle β can be from 10 to 20-degrees, for example, so that the top face of the insert 20 is oriented at the same angle β relative to the top surface of the slip 20.

By providing this angle β, the inserts 24 can better engage the casing C. For example, when the slip 20 is fully extended to a set position against the casing wall, the inserts 24 inclined by the acute angle β present cutting edges with respect to the inside surface of the casing C. With this arrangement, the inserts 24 can penetrate radially into the casing C. Angled toward the cones 12, this penetration can provide a secure hold-down against pushing and pulling forces that may be applied through the tool's mandrel 10 and element system.

The arrangement of the inserts 24, however, can damage the slips 20 or the inserts 24 themselves. As shown in FIG. 1B, load on the cone 12 during use of the downhole tool can cause the inserts 24 to put stress on the slip 20. As a result, the slip 20 can fracture at the edges of the pockets 22 toward the top surface 21 and the bottom surfaces 27 and 23 of the slip 20. In another form of failure shown in FIG. 1C, shear forces on the inserts 24 can cause the exposed ends of the inserts 24 to shear off along the slip's top surface 21.

The inserts 24 are typically composed of carbide, which is a dense and heavy material. When the downhole tool having the slips 20 with the carbide inserts 24 are milled out of the casing C, the inserts 24 tend to collect in the casing C and are hard to float back to the surface. In fact, in horizontal wells, the carbide inserts 24 may tend to collect at the heel of the horizontal section and cause potential problems for operations. Given that a well may have upwards of forty or fifty bridge plugs used during operations that are later milled out, a considerable number of the carbide inserts 24 from the milled plugs may be left in the casing and difficult to remove from downhole.

As noted previously, the small button inserts 24 create high stress points in the slips 20. This high stress is caused by the point loading on the edges of the inserts 24 or by a high stress across the cross-section of the inserts 24. During use then, the high stress points cause the inserts 24 to pitch, roll, and or depress in the slip 20. This can sometimes cause catastrophic failures of the slip's material, which can be metal, composite, plastic, etc.

Typically, to reduce the stress on the inserts 24, the cone and ramp angles can be adjusted to vary the radial load. The lengths of the inserts 24 as well as their angles in the slips 20 have also been adjusted. For instance, the angle of the inserts 24 has been adjusted both about the center plane of the slip 20 as well as the front plane of the slip 20 (either side-to-side or front-to-back). Some different angular arrangements for the inserts in the slips according to the prior art are discussed below.

FIGS. 2A-2B illustrate a side cross-section and end view of a slip 40 having a first arrangement of holes 46, 48, and 50 for inserts 60 according to the prior art. The slip segment 40 has first and second ends 42 and 44, which may be referred to as abutment end 42 and free end 44. An inner surface 41' preferably has a shape complementary to the outermost surface of a mandrel (not shown) to which the slip segment 40 is mounted. The slip segment 40 also has first and second sides 43 and 43' and has a forward or outer arcuate face 41. The free end 44 has an incline 44' on the inner surface 41'.

A plurality of buttons or inserts 60 are secured to the slip segment 40 and extend externally outwardly from the outer arcuate surface 41. They are secured in cavities defined in the slip segment 40. The cavities may be referred to as first, second and third cavities 46, 48, and 50 with longitudinal central axes 45, 47, and 49, respectively. As best shown in FIG. 2B, the cavities 46, 48, and 50 are oriented so that the longitudinal axes 45, 47, and 49 lie in intersecting vertical planes. As best shown in FIG. 2A, each of the longitudinal central axes 45, 47, and 49 can be angled from a horizontal axis by an angle θ, which may be, for example, approximately 15-degrees.

FIGS. 3A-3B illustrate a side cross-section and end view of a slip 40 having a second arrangement of holes 46, 48, and 50 for inserts 60 according to the prior art. As before, the slip segment 40 has first and second ends 42 and 44, which may be referred to as abutment end 42 and free end 44. The slip segment 40 has first and second sides 43 and 43' and has a forward or outer arcuate face 41. An arcuate inner surface 41' preferably conforms to the shape of the outer surface of a mandrel against which the slip segment 40 disposes. Finally, the free end 44 has an incline 44' on the inner surface 41'.

Buttons or inserts 60 are secured to the slip segment 40 and extend outwardly from outer arcuate face 41. The inserts 60 are secured in cavities, which include first, second and third cavities 46, 48, and 50. The cavities 46, 48, and 50 have longitudinal axes, identified as longitudinal axes 45, 47, and 49, respectively. The inserts 60 are preferably cylindrically shaped buttons with longitudinal central axes. The longitudinal axes 45, 47, and 49 are parallel, and as such, the longitudinal central axes of the inserts 60 in the slip segment 40 are parallel to one another. As best shown in FIG. 3A, each of longitudinal central axes 45, 47, and 49 can be angled from a horizontal axis by an angle θ, which may be, for example, approximately 15-degrees.

Although various arrangements of inserts in slip segments have been suggested in the past, operators are continually striving to use new materials, different load distributions, and the like to meet new challenges in the downhole environments.

The subject matter of the present disclosure is directed to overcoming, or at least reducing the effects of, one or more of the problems set forth above.

SUMMARY OF THE DISCLOSURE

A downhole apparatus has a slip body with inner and outer surfaces and with first and second ends. The first end is tapered with an incline on the inner surface relative to a centerline of the slip body, and the slip body is movable through interaction of the incline. For example, the incline may interact with a cone or other element of the apparatus.

At least one insert unit is disposed on the slip body. The at lease one insert unit has a base and has one or more first inserts extending from the base. A distal end of the one or more first inserts are exposed in the outer surface of the slip body, and the base of the at least one insert unit is disposed at an angle relative to the centerline.

In particular, the angle of the base can be disposed parallel to the incline of the slip body. In fact, the base can include a bottom surface exposed at the incline of the inner surface, and the base can encompass a greater surface area than the one or more first inserts.

In one particular example, the base can include a first side disposed across the first end of the slip body. The one or more first inserts can include at least two first inserts disposed side-by-side along the first side of the base. The at least two first inserts can each extend orthogonally relative to the first side of the base. In this example, this first side of the base can be a long side of the base, which can have a short side extending relative to the long side. The at least two first inserts can extend orthogonally relative to the short side of the base and thereby extend normal to the incline of the slip body.

In another particular example, the base of the at least one insert unit can include a first side disposed lengthwise on the slip body from the first end toward the second end. The one or more first inserts can include at least two first inserts disposed side-by-side along the first side of the base. The at least two first inserts can extend orthogonally relative to the first side of the base and thereby extend normal to the incline of the slip body. In this example, the first side of the base can be a long side having a short side extending relative to the long side. The at least two first inserts can extend orthogonally relative to this short side of the base.

In general, the slip body can include one or more independent segments of a slip assembly, one or more integrated segments of the slip assembly, or one or more integrated segments of the slip assembly separated from one another by divisions.

The slip body can be composed of a first material, and the at least one insert unit can be composed of one or more second materials. In fact, the first and second materials can be the same or different.

The one or more inserts can be integrally formed with the base or can be separate components from the base, in which case the base can be composed of a different material than the one or more first inserts.

In general, the one or more first inserts can include at least two first inserts each extending an axis parallel to one another on the base or extending axes diverging from one another on the base. Overall, the one or more first inserts can each extend an axis oriented at a first obtuse angle oblique to the centerline of the slip body and can more particularly extend substantially normal to the incline.

Each of the one or more first inserts can include a distal end exposed in the outer surface that has a lead face toward the first end of the slip body. The lead face can define a lead angle relative to the centerline of the slip body. The distal end can also define a tail face toward the second end of the slip body. The tail face can define a tail angle relative to the centerline of the slip body. Overall, the lead angle of the lead face can be related to the incline such that the lead angle defines an obtuse angle at the first end relative to the centerline.

The apparatus as disclosed herein can comprise a plug, a packer, a liner hanger, an anchoring device, a downhole tool, or at least a part of a downhole tool. For example, the apparatus can include an element disposed adjacent the first end of the slip body and having an inclined surface for interacting with the incline.

In another example, the apparatus can have a tool body with an inclined surface for interacting with the incline of the slip body, which can be a cone disposed on the tool body. In this case, the slip body can be a plurality of slip segments disposed about the tool body. Finally, the apparatus can include a mandrel and a cone. The mandrel has the inner surface of the slip body disposed adjacent thereto, and the cone is disposed on the mandrel. The cone has the inclined surface for interacting with the incline and moves the slip body away from the mandrel.

In a method of setting a slip on a downhole tool against an adjacent surface, such as casing, a body of the slip is moved toward the adjacent surface by interacting an incline of the body with an inclined surface of the tool. Load from the inclined surface is transmitted to a base on the body having a first surface area. The base is oriented at a base angle (preferably parallel) relative to the incline. The load from the first surface area of the base is transmitted to one or more inserts on the body extending from the base. The one or more inserts have a second surface area less than the first surface area. The load from the second surface area of the one or more inserts is transferred to one or more distal ends of the one or more inserts exposed beyond the body the slip, and the one or more distal ends engage against the adjacent surface.

In a method of assembling a slip for setting a downhole tool against a surface, such as casing, a body of the slip is formed having first and second surfaces and having first and second ends with a portion of the first surface at the first end having an incline relative to a centerline of the body. At least one insert unit is formed having a base with a first surface area and having one or more inserts with a second surface area less than the first surface area. The base of the insert unit is disposed on the body at a base angle relative to the incline. The one or more inserts of the insert unit are disposed on the body extending from the base with one or more distal ends exposed at the second surface of the body.

The foregoing summary is not intended to summarize each potential embodiment or every aspect of the present disclosure.

BRIEF DESCRIPTION OF THE DRAWINGS

FIG. 1A illustrates inserts used in a non-metallic slip according to the prior art.

FIG. 1B illustrates the slip of FIG. 1A during one type of failure.

FIG. 1C illustrates the slip of FIG. 1A during another type of failure.

FIG. 4A illustrates inserts according to the present disclosure for a slip shown disengaged from casing.

FIG. 4B illustrates the slip of FIG. 4A engaged with the casing.

FIG. 5 illustrates a geometric arrangement for inserts and a slip of the present disclosure.

FIGS. 10A-100 illustrate front, side, and perspective views of an insert unit according to the present disclosure.

DETAILED DESCRIPTION OF THE DISCLOSURE

Figure 2A:
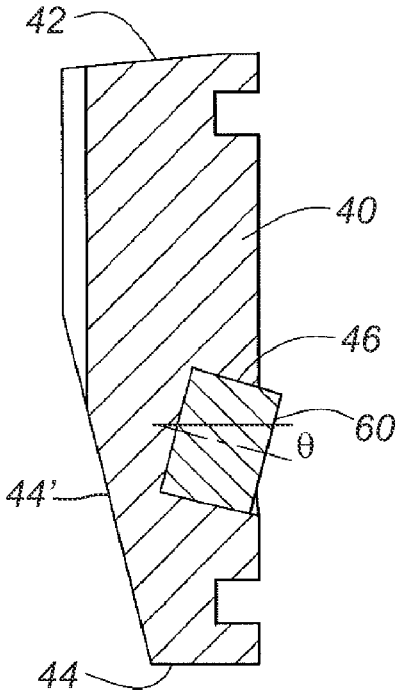
FIG. 2A (Prior Art)
FIGS. 2A-2B illustrate a side cross-section and end view of a slip having a first hole arrangement for inserts according to the prior art.
Figure 2B:
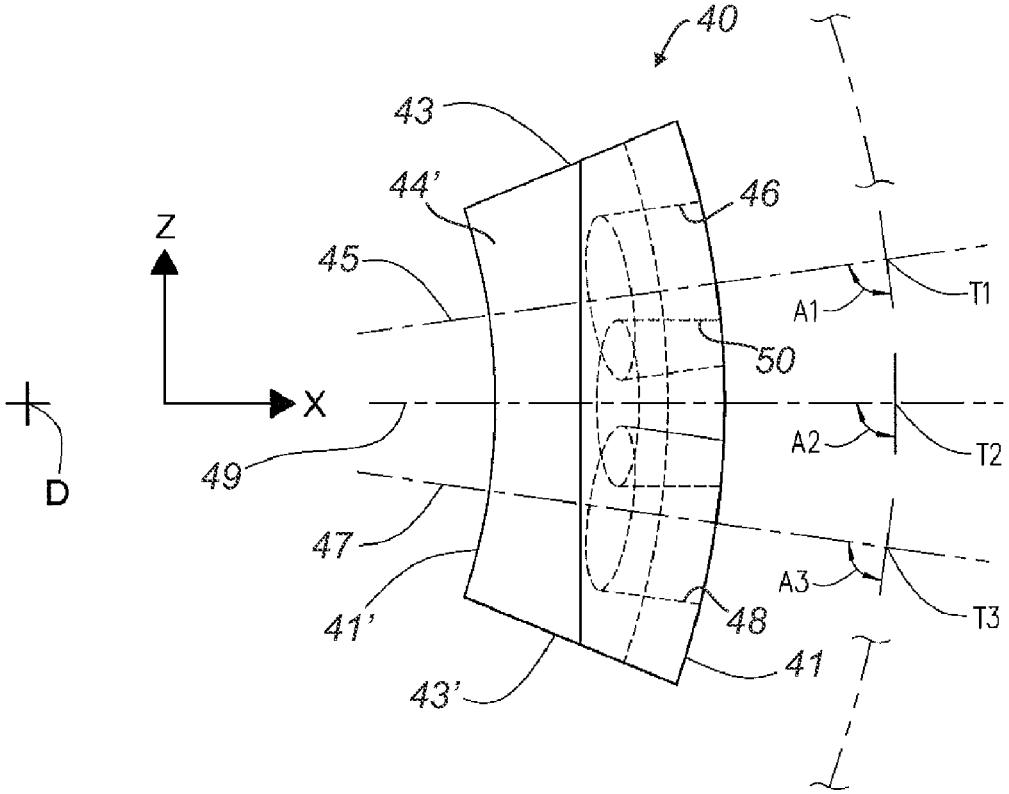
FIG. 2B (Prior Art)
Figure 3A:
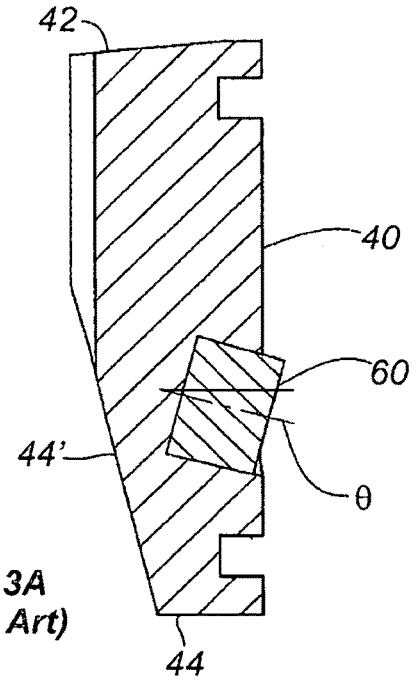
FIG. 3A (Prior Art)
FIGS. 3A-3B illustrate a side cross-section and end view of a slip having a second hole arrangement for inserts according to the prior art.
Figure 3B:
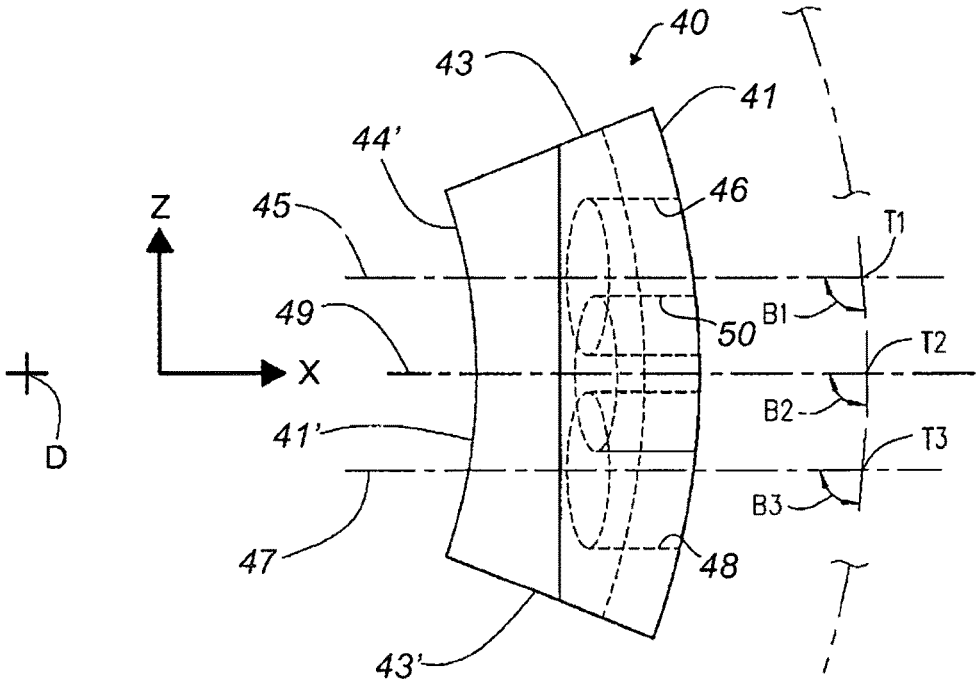
FIG. 3B (Prior Art)

FIG. 4A shows a slip body 120 of a slip assembly 100 disengaged with casing C, while FIG. 4B shows the slip body 120 pushed against the cone 32 to engage with the casing C. Contrary to the conventional arrangement of cylindrical shaped inserts disposed at an acute angle toward the inclined end of a prior art slip (FIGS. 1A-3B), the slip body 120 of the present disclosure has inserts 130 in an entirely different orientation. As shown in FIGS. 4A-4B, the slip body 120 can include one or more elements or segments of the slip assembly 100. The slip segment 120 is composed of a first material and has at least one insert 130 composed of a second material exposed in the segment's outer surface 124. The first and second materials are preferably different, but they could be the same. In general, the first material of the slip segment 120 can be cast iron, composite, or the like. Preferably, the slip segment 120 is composed of a millable material, such as a non-metallic material, a molded phenolic, a laminated non-metallic composite, an epoxy resin polymer with a glass fiber reinforcement, etc.

The second material of the inserts 130 can be metallic or non-metallic materials. For example, the inserts 130 can be composed of carbide or a metallic-ceramic composite material as conventionally used in the art. In general, the inserts 130 can be composed of a cast iron, a composite, a ceramic, a cermet (i.e., composites composed of ceramic and metallic materials), a powdered metal, or the like. Additionally, the inserts 130 preferably have a sufficient hardness, which may be a hardness equivalent to about 50-60 Rc.

As shown, the slip segment 120 is relatively thin and is generally elongated, being longer than it is wide. Although this configuration is not strictly necessary, the slip segment 120 does generally define a centerline running longitudinally along its length. The slip's centerline runs parallel to the centerline CL of the tool's mandrel 30, and when the slip segment 120 is moved for setting against surrounding casing C, the slip segment 120 moves away from the mandrel's centerline CL.

The slip segment 120 has inner and outer surfaces 122 and 124 and has first and second ends. The first end is tapered with an incline 123 on the inner surface 122, which engages against the inclined surface 33 of the cone 32, as shown in FIG. 4B. The slip's incline 123 defines a first angle $\theta_1$ relative to the centerline CL of the assembly 100 (i.e., of the tool T, the slip segment 120, the mandrel 30, and the like). As shown in FIG. 4B, the cone's inclined surface 33 defines a second angle $\theta_2$ relative to the center axis or centerline CL. In a preferred arrangement, the two inclined angles $\theta_1$ and $\theta_2$ are the same or nearly the same.

When initially run in hole, the slip segment 120 is disposed with the inner surface 122 adjacent the downhole tool's mandrel 30, as shown in FIG. 4A. During activation, the slip segment 120 moves away from the downhole tool through the interaction of the slip's incline 123 with the cone's inclined surface 33. Rather than having the inserts 130 angled at an angle according to the prior art, the inserts 130 have axes A angled away from the inclined end of the slip segment 120. In this arrangement, the inserts 130 are oriented in a manner that transfers the load directly through the bottom end of the insert 130, which puts the insert 130 in compression against the casing C. This load arrangement reduces the stress on the non-metallic slip segments 120 and enhances the performance of the non-metallic inserts 130, which in general preferably have good compressive strength.

As depicted in FIG. 5, the distal ends of the inserts 130 have one or more angled or conical surfaces exposed on the slip segment 120 that allow for proper engagement and load transfer to the casing C. In general, the insert 130 has a body, which can be cylindrical, rectangular, or any other suitable shape. The base or bottom end of the insert 130 can be flat to evenly distribute load.

As is typical, the insert 130 can be constructed from a long, wide bar or rod that is then machined to the prior length and width and given suitable faces. This technique is well suited for carbide or other hard types of materials and may also be used for other disclosed materials. Alternatively, the inserts 130 can be cast directly with the desired surfaces and sizes needed, if the material and tolerances allow for this.

In contrast to the flat bottom ends, the top end of the insert 130 can have one or more angled faces 136 and 138 on either side of the body's center axis A. A lead face 136, for example, angles from the central axis A at a lead angle, which creates a wicker edge 137. When exposed in the slip's outer surface, this lead face 136 faces toward the inclined end of the slip segment 120.

The sharpness of the edge 137 can be increased by a tail face 138 on the insert 130, which can angle from the central axis A at a tail angle. The tail face 138 faces toward the butt end of the slip segment 120, but other arrangements of inserts 130 do not necessarily have such a tail face 138. These faces 136 can be circular or rectilinear depending on the shape of the insert's body. Further details of the various angles, faces 136 and 138, central axis A, and other features of the insert 130 will now be discussed below.

As shown in the geometric arrangement for the slip assembly 100 in FIG. 5, the inclined surface 33 of the cone 32 as noted above defines an angle $\theta_2$ roughly the same as the angle $\theta_1$ of the slip's incline 123. In general, the angles $\theta_1$, $\theta_2$ between the slip segment 120 and cone 32 can be from 5 degrees to 75 degrees, but preferably the angles $\theta_1$, $\theta_2$ are around 15-degrees, which will be used in the examples herein.

As noted above, the top end of the insert 130 is exposed in the outer surface 124 of the slip segment 120, and the axis A of the insert 130 is oriented oblique (not perpendicular or parallel) to the centerline CL of the assembly (i.e., of the slip segment 120, mandrel 30, tool, and the like). In fact, the axis A is shown oriented at a first obtuse angle $\sigma_1$ relative to the centerline CL. Moreover, as specifically shown in the present arrangement, the axis A of the insert 130 is preferably oriented normal to the incline 123 on the slip segment 120 so that the bottom end 134 of the insert 130 is parallel to the incline 123.

With the insert 130 disposed in the slip segment 120 normal to the incline 123, the angle $\alpha$ of the lead face 136 is selected based on the angle $\theta_1$ of the incline 123 such that the face's angle $\alpha$ defines a second obtuse angle $\sigma_2$ relative to the centerline CL. The second obtuse angle $\sigma_2$ is approximately the sum of 90 degrees plus the first angle $\theta_1$ of the incline 123 and the angle $\alpha$ of the lead face 146. As shown here, for example, the angle $\theta_1$ of the incline 123 can be approximately 15-degrees, and the angle $\alpha$ of the lead face 146 on the insert 130 can be approximately 55-degrees. This would provide the lead face 56 with an angle $\mu$ of about 20-degrees outward from the outer surface 124 of the slip segment 120.

These angles can vary depending on the implementation, the diameter of the tool, the number of inserts 130 in the slip segment 120, the number of slips 120 used in the assembly 100, and other factors. In general, an incline angle $\theta_1$ of 15-degrees, plus or minus 5-degrees either way may be preferred. Likewise, the angle $\alpha$ of the lead face 136 may preferably be 55-degrees, plus or minus 10 or 15-degrees either way.

In a conventional arrangement discussed previously with reference to FIGS. 1A-1C, for example, the normal load acting on a prior art insert 24 from the cone 12 causes a point load on the slip 20 against the insert 24, which leads to fracturing. In the disclosed arrangement of FIGS. 4A-4B and 5, however, stress on the non-metallic slip segment 120 can be reduced because the normal load from the cone 32 is distributed against the bottom end 134 of the insert 130. Moreover, shear loads on the inserts 130 in the disclosed arrangement can be reduced, allowing the inserts 130 to perform at higher loads—even when the inserts 130 are non-metallic. Thus, the disclosed slip and insert design is believed to allow for higher loads/pressures than the conventional composite slip designs.

Figure 6A:
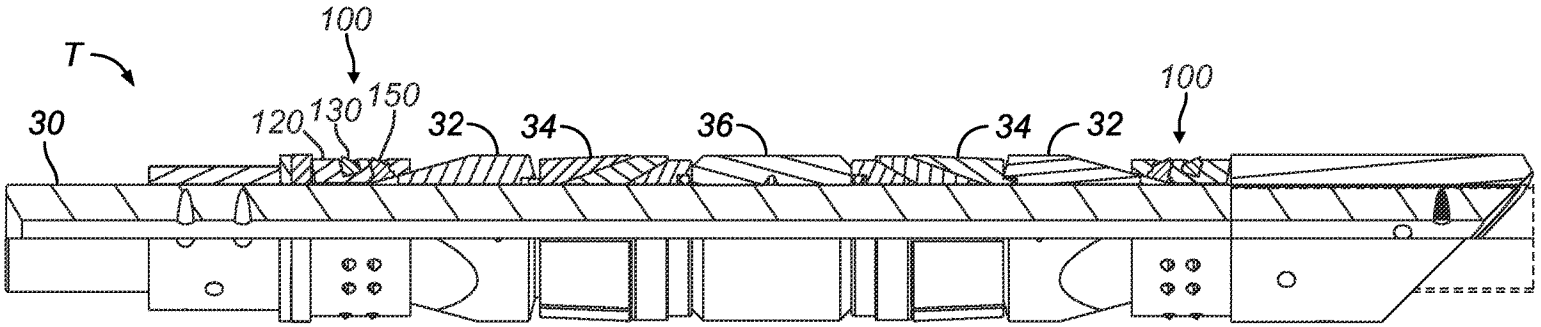
FIG. 6A illustrates a downhole tool in partial cross-section having slip assemblies according to the present disclosure.

Slip assemblies having slip segments 120 with inserts 130 as described above can be used on any of a number of downhole tools. Additionally, the geometry of the inserts 130 can be used on other types of inserts disclosed herein. In particular, FIG. 6A illustrates a downhole tool T in partial cross-section having slip assemblies 100 according to the present disclosure. The downhole tool T can be a bridge plug as shown, but it could also be a packer, a liner hanger, an anchoring device, or other downhole tool.

The tool T has a mandrel 30 having cones 32 and backup rings 34 arranged on both sides of a packing element 36. Outside the inclined cones 32, the tool T has slip assemblies 100 with one or more slip bodies or segments 120. Together, the slip segments 120 along with its corresponding cone 32 can be referred to as a slip assembly, or in other instances, just the slip segments 120 may be referred to as a slip assembly. In either case, either reference may be used interchangeably throughout the present disclosure.

As a bridge plug, the tool T of FIG. 6A is preferably composed mostly of non-metallic components according to procedures and details as disclosed, for example, in U.S. Pat. No. 7,124,831, which is incorporated herein by reference in its entirety. This makes the tool T easy to mill out after use. When deployed downhole, the plug T is activated by a wireline setting tool (not shown), which uses conventional techniques of pulling against the mandrel 30 while simultaneously pushing upper components against the slip segments 120 of the assemblies 100. The plug T can be set in other ways, such as being set hydraulically with a hydraulic setting tool. As a result, the slip segments 120 ride up the cones 32, the cones 32 move along the mandrel 30 toward one another, and the packing element 36 compresses and extends outward to engage a surrounding casing C. The backup elements 34 control the extrusion of the packing element 36.

The slip segments 120 are pushed outward in the process to engage the wall of the casing C, which both maintains the plug T in place in the casing C and keeps the packing element 36 contained. The slip segments 120 divide, split, tear, or otherwise separate from one another along recesses, cuts, edges, or other divisions 125 that run longitudinally at least partially along the inside of the assembly 100. The number of these features can vary for a given implementation. In some examples, as many as six separate slip segments 120 may be provided around the circumference of the slip assembly 100, although there could be any number of slips.

The force used to set the plug T may be as high as 30,000 lbf. and could be as high as 85,000 lbf. These values are only meant to be examples and could vary for the size of the plug T. In any event, once set, the plug T isolates upper and lower portions of the casing C so that frac and other operations can be completed uphole of the plug T, while pressure is kept from downhole locations. When used during frac operations, for example, the plug T may isolate pressures of 10,000 psi or so.

As will be appreciated, any slipping or loosening of the plug T can compromise operations. Therefore, it is important that the slip segments 120 sufficiently grip the inside of the casing C. At the same time, however, the plug T and most of its components are preferably composed of millable materials because the plug T is milled out of the casing C once operations are done, as noted previously. As many as fifty such plugs T can be used in one well and must be milled out at the end of operations. Therefore, having reliable plugs T composed of entirely of millable material is of particular interest to operators. To that end, the slip assemblies 100 of the present disclosure are particularly suited for such bridge plugs T, as well as packers, and other downhole tools, and the challenges they offer.

Various types of slip assemblies 100 can be used for a tool T as in FIG. 6A. A number of slip assemblies according to the present disclosure are discussed below.

Figure 6C:
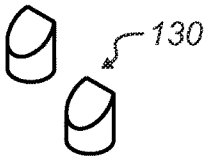
FIG. 6C illustrates a perspective view of a first insert type for the disclosed slip assembly.
Figure 6D:
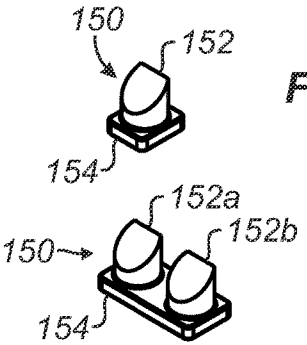
FIG. 6D illustrates a perspective view of a second insert type for the disclosed slip assembly.
Figure 6B:
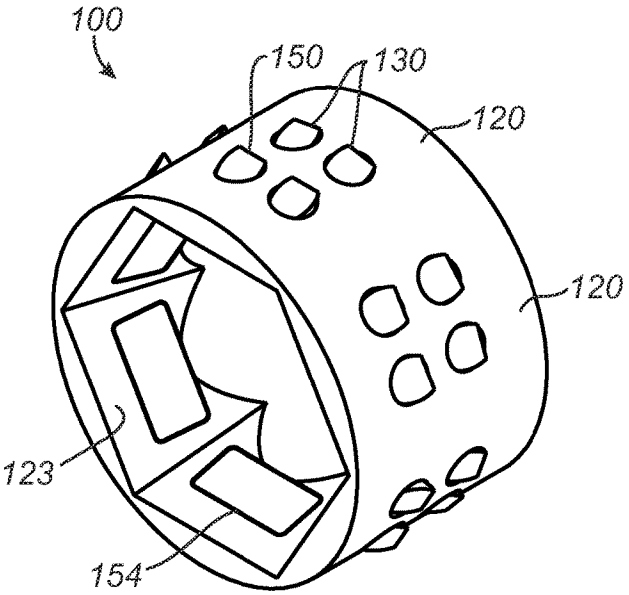
FIG. 6B illustrates a perspective view of a slip assembly according to the present disclosure.

As in FIGS. 6B-6D, the slip assemblies 100 can each have two types of inserts or buttons 130 and 150 according to the present disclosure. It will be appreciated, of course, that the slip assemblies 100 can have only one type of inserts or buttons 130 and 150 as proposed herein. Additionally, it will be appreciated that the slip assemblies 100 one each end can be similar to one another as shown or can be different from one another.

For reference, FIG. 6B illustrates a perspective view of a slip assembly 100 for the disclosed tool T of FIG. 6A. FIG. 6C illustrates a perspective view of a first insert type for the disclosed slip assembly 100, while FIG. 6D illustrates a perspective view of a second insert type for the disclosed slip assembly 100.

As shown in FIG. 6C, one or more of the inserts 130 are similar to those discussed previously. As shown in FIG. 6D, the other inserts 150, which are discussed in more detail below, are units having one or more buttons or inserts 152*a-b* disposed on a base 154 from which the one or more inserts 152*a-b* extend.

In general, the base 154 encompasses a greater surface area than the one or more inserts 152*a-b*. For example, two inserts 152*a-b* can be used adjacent one another on the base 154, which interconnects the two inserts 152*a-b*. As such, these insert units 150 can orient together in holes and pockets of the slip segment 120. Although two inserts 152*a-b* are shown, it will be appreciated that the units 150 can have one or more inserts 152.

When the assembly 100 of FIGS. 6A-6B is used on a tool, such as plug T, to set against a surrounding surface, such as a casing wall, the slip segments 120 are moved toward the adjacent surface by interacting the inclines 123 with the inclined surface of the tool, such as provided by the cone 32. Load from the cone's inclined surface is transmitted to the first surface area of the base 154 on the segment 120. If the base 154 is exposed at the incline as in FIG. 6B, then the load transfers directly from the cone's incline surfaced to the base 154. Otherwise, an intermediate portion of the segment's 120 material may be interposed between the base 154 and cone's surface if the base 154 is embedded in the slip segment 120.

The load from the first surface area of the base 154 is transmitted to the second (smaller) surface area of the one or more inserts 152*a-b* extending from the base 154. As noted herein, the load can be transferred along axes of these inserts 152*a-b* normal to the inclined surface. Therefore, it is preferred that the base 154 be orieinted parallel to the incline 123 and that the inserts 152*a-b* be oriented normal to the base 154 (and by extension the incline 123), although it is possible for the base 154 to be differently while the inserts 152*a-c* are still oriented normal to the incline 123 or for the base 154 to be oriented parallel while the inserts 152*a-c* are oriented differently. Either way, the load from the second surface area of the one or more inserts 152*a-b* is transferred to the one or more distal ends of the inserts 152*a-b* exposed beyond the body the segments 120 so the distal ends can engage against the adjacent surface.

Assembling the slip assembly 100 can involve a number of steps. In general, a body of the slip assembly 100, such as integrated segments 120 as in FIG. 6B, is formed having first and second surfaces and having first and second ends with a portion of the first surface at the first end having an incline relative to a centerline of the body. Forming the body of the slip assembly 100 can use molding, casting, machining, and the like and can depend on the type of material used. The body of the assembly 100 as noted herein can have independent segments, if desired.

At least one insert unit 150 is formed having a base 154 with a first surface area and having one or more inserts 152*a-b* with a second surface area less than the first surface area. As noted herein, the base 154 and inserts 152*a-b* can be integrally or separately formed using machining, casting, molding, etc., and they can be made of the same or different materials. The base 154 of the insert unit 150 is disposed on the body of the assembly 100 at a base angle relative to the incline 123, and the one or more inserts 152*a-b* of the insert unit 150 are disposed on the body extending from the base 154 with one or more distal ends exposed at the second surface of the body. As noted herein, disposing the base 154 and inserts 152*a-b* may involve inserting these into exposed holes and slots, which can be machined into the assembly's segments 120. Alternatively, the base 154 and/or the inserts 152*a-b* can be molded embedded into the material of the assembly's segments.

Once formed, the slip assembly 100 can be installed on a tool, such as a bridge plug, along with the other components. If the assembly 100 has independent segments 120, then retention bands may be installed to hold the segments around the mandrel of the tool. These and other conventional steps would be performed to complete the slip assembly 100.

Figure 7A:
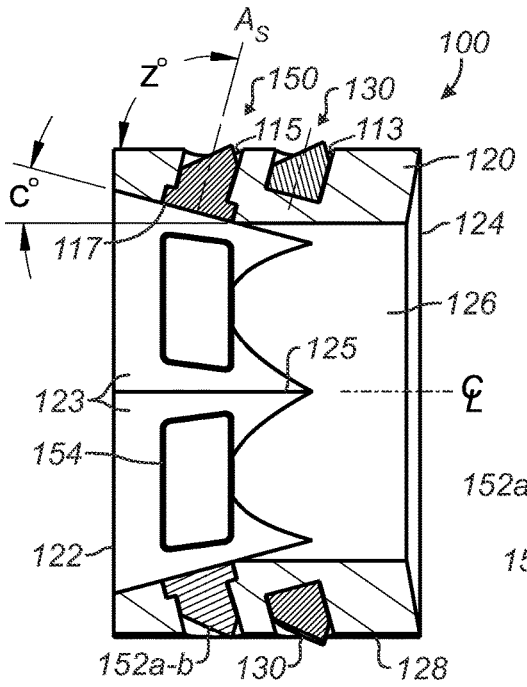
FIGS. 7A-7B illustrate side cross-section and end views of another slip assembly according to the present disclosure.
Figure 7B:
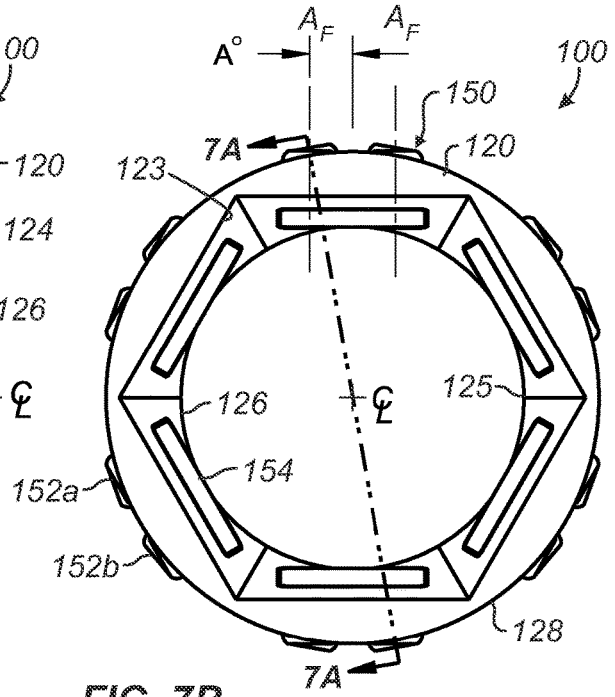

Looking now at FIGS. 7A-7B, side cross-section and end views show a slip assembly 100 according to the present disclosure, which can be similar to the assembly of FIG. 6B. The slip assembly 100 includes a slip body 120 having inner and outer surfaces 126 and 128 and having first and second ends 122 and 124. The first end 122 is tapered with an incline 123 at a first angle on the inner surface 126 relative to a centerline CL of the slip body 120. When used on a downhole tool (not shown), the slip body 120 is disposed with the inner surface 126 adjacent the tool's mandrel (30) and movable away from the tool through interaction of the incline 123 with the cone (32) of the tool.

The slip body 120 of the assembly 100 can be made up of a plurality of independent segments or a plurality of integrated segments, such as shown. Thus, slip body and segment may be used interchangeably herein. The integrated segments 120 can be separated from one another by divisions, such as shown.

In the current configuration, this slip assembly 100 is of a shallow cone type with the ends 122 of the various slip segments 120 defining shallow cone surfaces 123, although it could have steep cone surfaces. The divisions 125 in the form of edges, scores, or the like at least partially separate the various slip segments 120 around the circumference of the assembly 100. The inner cylindrical surface 126 may lack divisions. More or less separation between the slip segments 120 can be provided, as will be appreciated.

Inserts 130 on the slip segments 120 can be similar to those disclosed previously. As such, these inserts 130 dispose in partial holes 113 in the outer surface 128 of the assembly 100 and are oriented to be substantially normal to the cone surface (32) when engaged against the segments' cone surfaces 123, as discussed above.

Insert units 150 are disposed toward the incline 123 of the segments 120 with the bases 154 of the units 150 exposed as part of the incline 123 of the assembly 100. Being exposed as part of the incline, the base 154 of the unit 150 is disposed at a base angle comparable (parallel) to the angle of the incline 123.

The insert units 150 dispose in first holes 115 and pockets 117 defined in the segments 120 so that the top ends of the inserts 152*a-b* on the units 150 are exposed above the outside surface 128 of the assembly 100. Accordingly, the inserts 152*a-b* on the units 150 are arranged to be substantially normal to the cone surface (32) when engaged against the segments' inclines 123 and the units' bases 154.

As mentioned above, the insert units 150 disposed on the slip segment 120 each have a base 154 and have one or more first inserts 152*a-b* disposed on the base 154. Here, the units 150 each have two inserts 152*a-b*, although other configurations can be used (i.e., the units 150 can also have one insert 152 or more than two inserts 152). Distal ends of the inserts 152*a-b* are exposed in the outer surface 128 of the slip segments 120, and angles of the bases 154 of the units 150 are disposed parallel to the inclines 123 of the slip segments 120.

In the present example, the base 154 is substantially flat and is a rectangular plate in shape. In general, the base 154 can have any shape and does not have to be flat. For example, the base 154 can have a slight curvature or angle to it. In any event, the base 154 is disposed on the slip body 120 at a base angle relative to the centerline CL. Again, being exposed as part of the incline 123, the base 154 of the unit 150 is disposed at a base angle C comparable (parallel) to the angle of the incline 123.

In the end, the base 154 is wide and provides a larger surface area to distribute load. For example, the inserts 152*a-b* on the base 154 may have a 0.313-in diameter. The largest possible load distribution area for the inserts 152*a-b* alone would be 0.076-in$^2$. However, the base 154 can be 1-in wide by 0.4-in long. In this case, the insert 152*a-b* with the 0.313-in diameter would have a load distribution area of 0.4-int.

The base 154 has its long side disposed along the tapered end 122 of the slip assembly 100, and the inserts 152*a-b* are disposed side-by-side along the long side of the rectangular base 154, as best shown in FIG. 7B. As also shown in FIG. 7B, the inserts 152*a-b* extend on front axes $A_F$, which are orthogonal to the long side of the rectangular base 154. As shown in FIG. 7A, the inserts 152*a-b* also extend on side axes $A_S$, which are orthogonal to the short side of the rectangular plate 154. Accordingly, the side axes $A_S$ of the inserts 152*a-b* define an obtuse angle Z relative to the outer surface of the assembly 100. This obtuse angle Z is related to the angle C of the incline 123 in that the side axes $A_S$ are perpendicular (or at least approximately perpendicular) to the incline 123. In one embodiment wherein the angle of the incline 123 is C, the obtuse angle Z is about C plus 90-degrees, although equivalent variations of plus or minus various degrees can achieve the same purposes and results.

Although shown having two inserts 152*a-b*, the insert unit 150 can have any number of inserts. The inserts 152*a-b* can be disposed at any angle relative to one another and can be disposed at any angle relative to the base 154. The base 154 can be disposed on the inside of the segments' inclines 123 or elsewhere, and the inserts 152*a-b* can be long enough to protrude from the ID to the OD of the slip assembly 100 to provide a direct load distribution. Alternatively, the base 154 can be embedded or molded in the slip assembly 100 a distance from the incline 123, and the inserts 152*a-b* can extend past the OD of the slip assembly 100.

Having several inserts 152*a-b* combined into one piece as the unit 150 can speed up assembly steps and can allow the bigger base 154 to distribute the load. By utilizing this design, the insert configuration is still adjustable as with historical solutions, but the contact between the inserts 152*a-b* and slip segment 120 as well as the slip segment 120 and cone (32) is greatly increased.

As before, the slip body or segments 120 can be composed of a first material, and the inserts 130 and insert units 150 can be composed of second materials, which can be the same or different from the first material. In general, the material of the slip body or segments 120 can be a cast iron, a metallic material, a non-metallic material, a composite, a millable material, a molded phenolic, a laminated non-metallic composite, an epoxy resin polymer with a glass fiber reinforcement, or a combination thereof. The material of the inserts 130 and units 150 can be a metallic material, a non-metallic material, a composite, a millable material, a carbide, a metallic-ceramic composite material, a cast iron, a ceramic, a cermet (i.e., composites composed of ceramic and metallic materials), a powdered metal, a molded phenolic, a laminated non-metallic composite, an epoxy resin polymer with a glass fiber reinforcement, or a combination thereof.

The insert units 150 can be composed of a single material and can be manufactured by a combination of casting and machining. Alternatively, the base 154 and inserts 152*a-b* can be manufactured as different components and combined together. As such, the base 154 and inserts 152*a-b* can be composed of different materials or the same materials. If the inserts 152*a-b* are manufactured separate from the base 154, the inserts 152*a-b* can affix to the base 154 before assembly of the insert unit 150 on the slip segments 120. Alternatively, the inserts 152*a-b* and base 154 may be independently affixed to the slip segment 120 using conventional techniques and may abut or contact one another. These and other manufacturing techniques can be used. In one particular implementation, the base 154 and inserts 152*a-b* are composed of a sintered powdered metal and are molded into a composite material of the slip segment 120.

As noted above, the side axes $A_S$ of the inserts 152*a-b* can be normal to the incline 123 on the slip segments 120 so the axes $A_S$ will be perpendicular to the cone's inclined surface (33) when engaged thereagainst. Because the slip segments 120 fit around a cylindrical tool, the slip segments 120 can define arcuate or partial cylindrical surfaces 126 and 128 as shown in FIGS. 7A-7B. The front axes $A_F$ of the inserts 152*a-b* can be parallel to one another, as in FIG. 7B. Alternatively, the front axes $A_F$ for the inserts 152*a-b* can be normal to the curvature of the assembly 100. The separate inserts 130 can be similarly arranged as the units' inserts 152*a-b* or may be arranged differently. In fact, the assemblies 100 or one or more the segments 120 may lack such separate inserts 130. These and other orientations can be used.

Figure 8A:
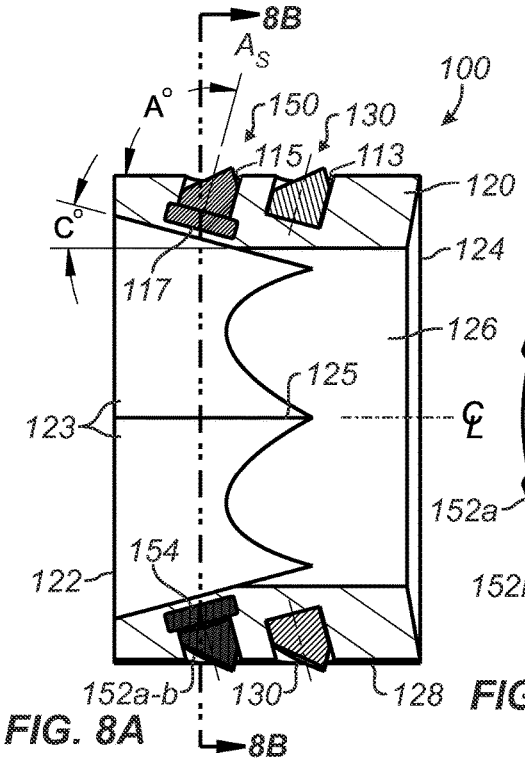
FIGS. 8A-8B illustrate side cross-section and end views of yet another slip assembly according to the present disclosure.
Figure 8B:
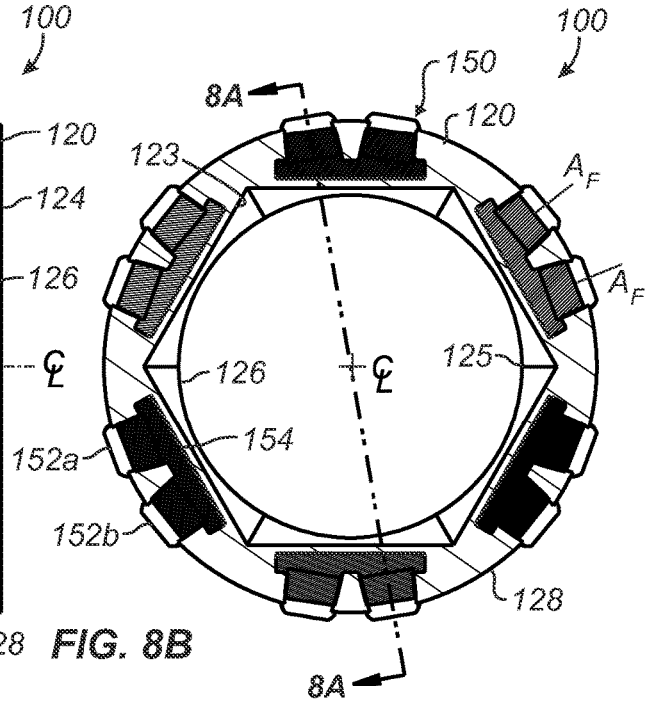

Another slip assembly 100 in FIGS. 8A-8B is similar to that discussed above. Here, the bases 154 of the insert units 150 are not exposed at the cone inclines 123 of the assembly 100. Instead, the base 154 of insert units 150 dispose away from the cone inclines 123, and the inserts 152*a-b* are disposed in partial holes 115 defined in the outside surface 128 of the assembly 100. Even though it is embedded, the base 154 of the unit 150 is disposed at a base angle C comparable (parallel) to the angle of the incline 123, although variation in the base angle can be used.

Assembly for this arrangement may involve molding the insert units 150 in place when forming the composite slip assembly 100. Alternatively, the bases 154 can be molded as separate components in place in the segments 120, and the inserts 152*a-b* can be positioned as separate components in holes 115 and affixed using known techniques. Either way, the base 154 can support the proximal ends of the inserts 152*a-b* and can have flat or angled surfaces to orient the inserts 152*a-b* as desired.

In this arrangement contrary to previous arrangements, the front axes $A_F$ of the inserts 152*a-b* of the units 150 diverge from one another. When disposed about the assembly 100, the axes $A_F$ can be arranged to extend radially around the circumference of the assembly 100, as best shown in FIG. 8B.

Figure 9C:
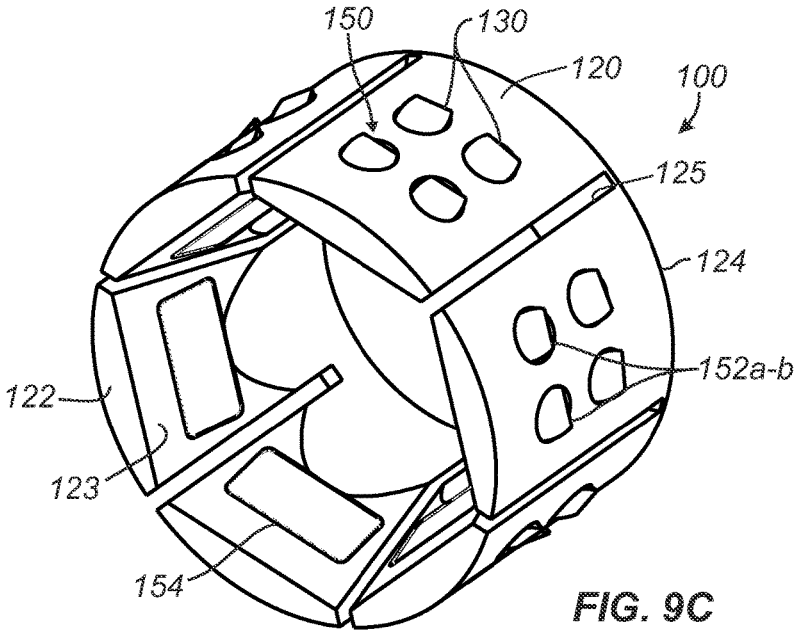
FIGS. 9A-9C illustrate side cross-section, end, and perspective views of another slip assembly according to the present disclosure.
Figure 9A:
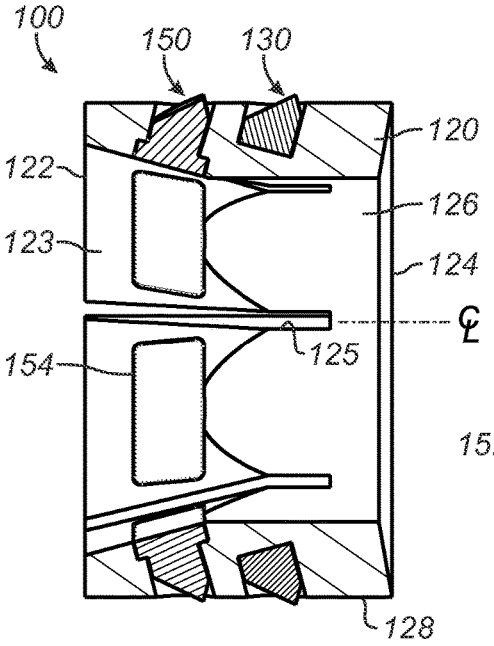
Figure 9B:
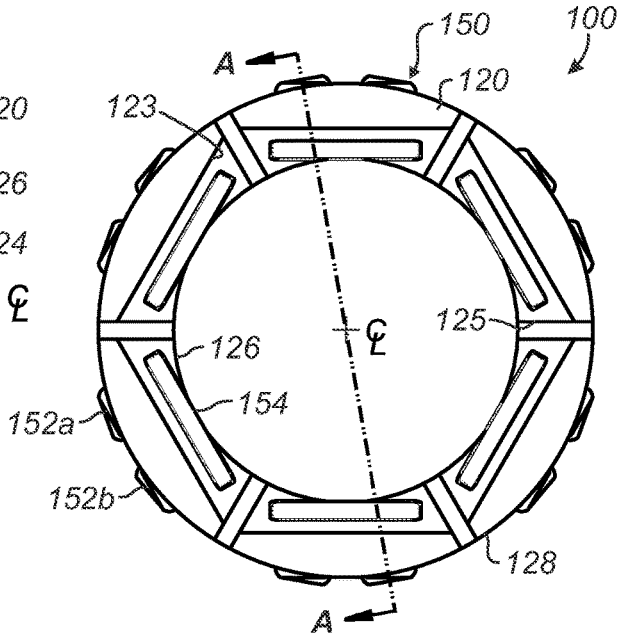

Rather than having assemblies 100 with practically continuous ringed bodies having the segments 120 formed by partial divisions 125, more segmented assemblies can be used. For example, FIGS. 9A-9C illustrate side cross-section, end, and perspective views of yet another slip assembly 100 according to the present disclosure. The segments 120 in this assembly 100 have well-defined divisions or separations 125. In fact, the various segments 120 are practically independent components interconnected by bridges, rings, or other portions of the assembly 100 between the segments 120. In other implementations, the segments 120 can be completely independent from one another and can be held together by retention bands or the like, as known in the art.

Figure 10C:
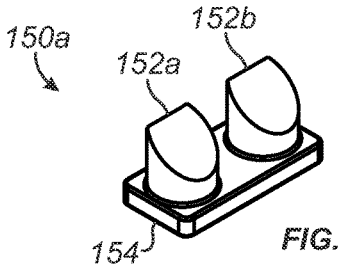
Figure 10A:
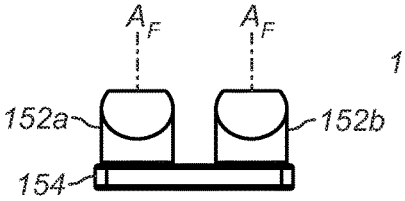
Figure 10B:
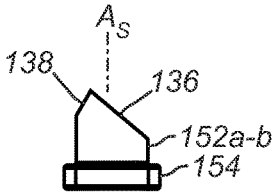

The one or more inserts 152*a-b* disposed on the insert units 150 for the disclosed slip assemblies 100 can have various configurations. A number of such arrangements are discussed below. FIGS. 10A-10C illustrate front, side, and perspective views of an insert unit 150*a* according to the present disclosure. The unit 150*a* has a pair of inserts 152*a-b* disposed side-by-side on an interconnecting base 154 similar to what was disclosed above with reference to FIGS. 6B, 6D, and 7A-8B. As best shown in FIG. 10B, the distal ends of the inserts 152*a-b* can have angled faces 136, 138 similar to those disclosed elsewhere herein. As best shown in FIG. 10A, the front axes $A_F$ of the inserts 152*a-b* are parallel to one another and are generally perpendicular to the base 154. As best shown in FIG. 10B, the side axes $A_S$ of the inserts 152*a-b* are generally perpendicular to the base 154.

Figure 11C:
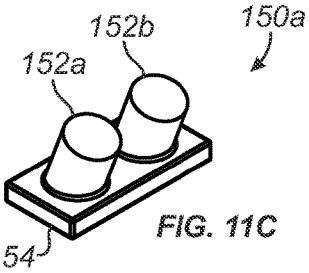
FIGS. 11A-11C illustrate front, side, and perspective views of another insert unit according to the present disclosure.
Figure 11A:
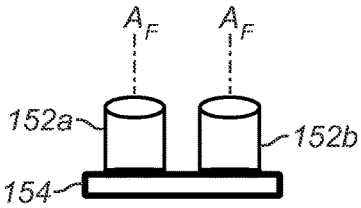
Figure 11B:
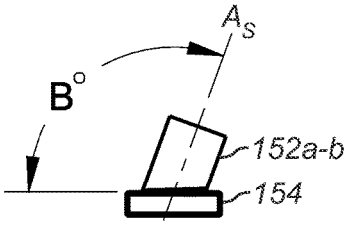

FIGS. 11A-11C illustrate front, side, and perspective views of another insert unit 150*b* according to the present disclosure. The unit 150*b* has a pair of inserts 152*a-b* disposed side-by-side on an interconnecting base 154. The distal ends of the inserts 152*a-b* can have cylindrical surfaces 153 as disclosed herein. As best shown in FIG. 11A, the front axes $A_F$ of the inserts 152*a-b* are parallel to one another and are generally perpendicular to the base 154. As best shown in FIG. 11B, the side axes $A_S$ of the inserts 152*a-b* are generally angled relative to the base 154 at an angle B, which can be about 110-degrees.

Figure 12C:
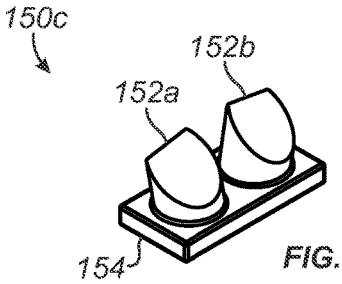
FIGS. 12A-12C illustrate front, side, and perspective views of yet another insert unit according to the present disclosure.
Figure 12A:
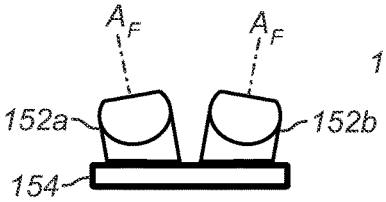
Figure 12B:
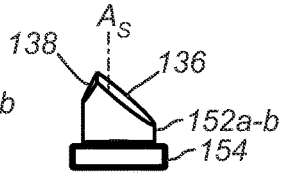

FIGS. 12A-12C illustrate front, side, and perspective views of yet another insert unit 150*c* according to the present disclosure. The unit 150*c* has a pair of inserts 152*a-b* disposed side-by-side on an interconnecting base 154. The distal ends of the inserts 152*a-b* can have angled surfaces 136, 138 as disclosed herein. As best shown in FIG. 12A, the front axes $A_F$ of the inserts 152*a-b* diverge from one another and are generally angled at an angle, which may or may not be related to the radius of curvature of the assembly 100. As best shown in FIG. 12B, the side axes $A_S$ of the inserts 152*a-b* are generally perpendicular to the base 154. In other arrangements, the sides axes As of the inserts can diverge from one another. For example, one side axis As of an insert 152*a* can be perpendicular to the base 154, while the axis As of the adjacent insert 152*b* can be at a different angle. Likewise, each of the adjacent inserts 152*a-b* can have different angles diverging from perpendicular to the base.

As will be appreciated, the insert units 150 as disclosed herein can include and combine one or more of the features of the insert units 150*a-c* disclosed above. Accordingly, the insert unit 150*a* of FIGS. 10A-10C or the unit 150*c* of FIGS. 12A-12C can have cylindrical ends on one or more of the inserts 152*a-c*. The ends of one or more of the inserts 152*a-b* on the unit 150*b* of FIGS. 11A-11B can have angled surfaces, and any of the insert units 150*a-c* can have the various faces and axes $A_F$ and $A_S$, as disclosed herein.

Figure 13:
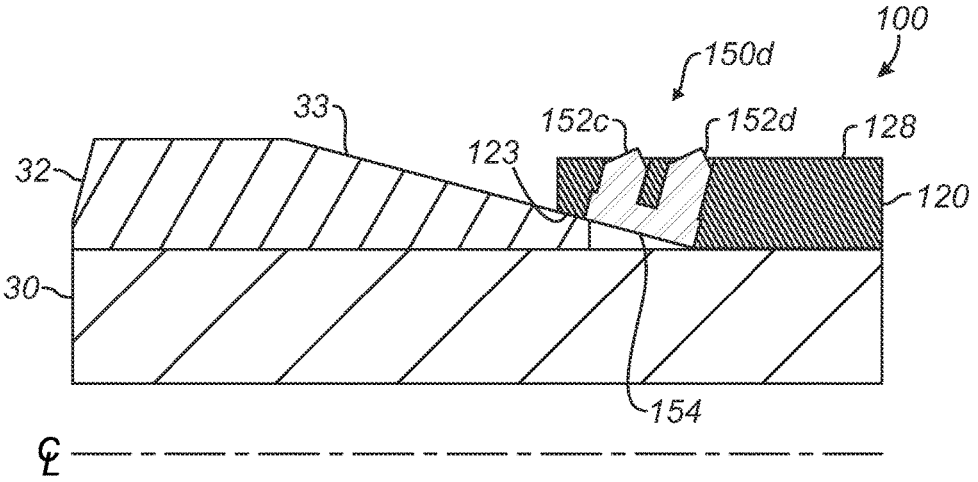
FIG. 13 illustrates a cross-sectional view of an insert unit in a slip assembly according to another arrangement.

In previous arrangements, the insert units 150 were oriented across the inclined end of the slip assembly 100. Other configurations can be used. For example, FIG. 13 illustrates a cross-sectional view of another configuration of an insert unit 150*d* in a slip assembly 100 according to another arrangement. Here, the base 154 is disposed on a portion of the slip's incline 123 as before, but it is oriented lengthwise along the length of the slip segment 120. Being exposed as part of the incline 123, the base 154 of the unit 150 is disposed at a base angle comparable (e.g., parallel) to the angle of the incline 123.

The base 154 has side-by-side inserts 152*c-d* along it length. These inserts 152*c-d* are of different lengths that extend to the outside surface 128 of the segment 120 so that their distal ends lie exposed together on the segment's surface. Although the base 154 is exposed as part of the incline 123, the base 154 could be embedded in the slip body 120 and could be oriented at a variation in the angle to the incline 123.

Figure 14A:
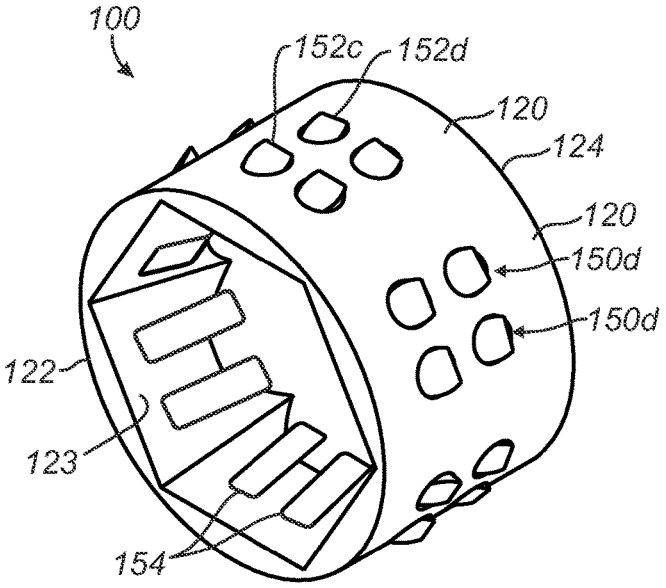
FIG. 14A illustrates a perspective view of a slip assembly with the insert units of FIG. 13.
Figure 14B:
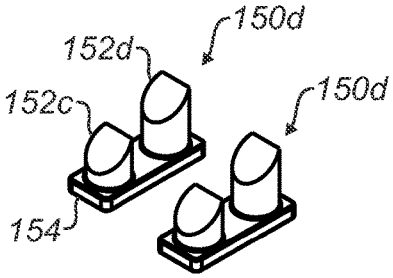
FIG. 14B illustrates a perspective view of the insert units of FIG. 14A.

FIG. 14A illustrates a perspective view of the slip assembly 100 with insert units 150*d* of FIG. 13. As can be seen, each segment 120 can have two adjacently arranged units 150*d* with the different sized inserts 150*c-d* disposed front-to-back. Particulars of the insert units 150*d* are shown in FIG. 14B.

Figure 14C:
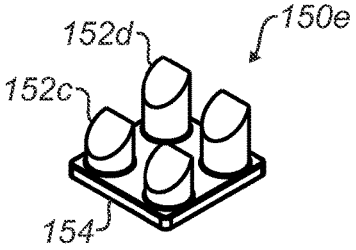
FIG. 14C illustrates a perspective view of another insert unit according to the present disclosure.

The sideways and lengthwise arrangements of the insert units disclosed above can be combined together to provide yet another insert unit for use with a slip assembly. As shown in FIG. 14C, this insert unit 150*e* includes four inserts 152*c-d* disposed on the base 154, although more or less could be used. The front inserts 152*c* have the same length, and the back inserts 152*d* have a greater length.

In the present disclosure, terms such as body, element, and segment may be used for a slip assembly as a whole, for an individual slip, or for one slip of several slips on a slip assembly. Likewise, terms such as assembly, unit, or body may be used interchangeably herein.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole apparatus for use adjacent a downhole surface, the apparatus comprising:

a slip body having first and second surfaces and having first and second ends, a portion of the first surface at the first end having an incline relative to a centerline of the slip body, the slip body movable toward the downhole surface through interaction of the incline; and at least one insert unit disposed on the slip body, the at least one insert unit having a base and having one or more first inserts extending from the base, the one or more first inserts each extending a side axis oriented oblique to the centerline of the slip body, a first distal end of the one or more first inserts exposed at the second surface of the slip body and engageable with a load against the downhole surface, a first proximal end of the one or more first inserts disposed adjacent the base and defining a first surface area, the base disposed on the slip body at a base angle relative to the centerline and defining a second surface area, wherein the base angle is disposed parallel to the incline of the slip body, whereby the base transmits the supported load orthogonal to the incline, and the second surface area being greater than the first surface area and supporting the load of the one or more first inserts.

2. The apparatus of claim 1, wherein the base of the at least one insert unit comprises a bottom surface exposed at the incline of the first surface, whereby the base transmits the supported load directly to the incline.

3. The apparatus of claim 1, wherein the slip body comprises:

one or more independent segments of a slip assembly;

one or more integrated segments of the slip assembly; or one or more integrated segments of the slip assembly separated from one another by divisions.

4. The apparatus of claim 1, wherein the one or more first inserts are integrally formed with the base.

5. The apparatus of claim 1, wherein the base of the at least one insert unit is composed of a different material than the one or more first inserts.

6. The apparatus of claim 1, wherein the one or more first inserts comprises a proximal end disposed adjacent a top surface of the base.

7. The apparatus of claim 1, wherein the one or more first inserts comprises at least two first inserts disposed side-by-side on the base and extending along axes parallel to one another.

8. The apparatus of claim 1, wherein the one or more first inserts comprises at least two first inserts disposed side-by-side on the base and extending along axes diverging from one another.

9. The apparatus of claim 1, wherein the side axis of at least one of the one or more first inserts is substantially normal to the incline.

10. The apparatus of claim 1, wherein the first distal end of the one or more first inserts defines a lead face toward the first end of the slip body, the lead face defining a lead angle relative to the centerline of the slip body.

11. The apparatus of claim 10, wherein the first distal end defines a tail face toward the second end of the slip body, the tail face defining a tail angle relative to the centerline of the slip body.

12. The apparatus of claim 1, wherein the base of the at least one insert unit comprises a first side disposed across the first end of the slip body; and wherein the one or more first inserts comprise at least two first inserts disposed side-by-side along the first side of the base.

13. The apparatus of claim 1, wherein the base of the at least one insert unit comprises a first side disposed lengthwise on the slip body from the first end toward the second end; and wherein the one or more first inserts comprises at least two first inserts disposed side-by-side along the first side of the base.

14. The apparatus of claim 1, further comprising at least one second insert disposed on the slip body and having a second distal end exposed in the second surface of the slip body.

15. The apparatus of claim 14, wherein the at least one second insert defines an axis being oriented oblique to the centerline of the slip body.

16. The apparatus of claim 1, further comprising an element disposed adjacent the first end of the slip body and having an inclined surface for interacting with the incline.

17. The apparatus of claim 1, further comprising a tool body having an inclined surface for interacting with the incline of the slip body.

18. The apparatus of claim 17, wherein the inclined surface comprises a cone disposed on the tool body.

19. The apparatus of claim 1 further comprising:

a mandrel having the first surface of the slip body disposed adjacent thereto; and a cone disposed on the mandrel, the cone having an inclined surface for interacting with the incline and moving the slip body away from the mandrel.

20. The apparatus of claim 1, wherein the apparatus comprises a plug, a packer, a liner hanger, an anchoring device, or a downhole tool.

21. A downhole apparatus for use adjacent a downhole surface, the apparatus comprising:

a slip body having first and second surfaces and having first and second ends, a portion of the first surface at the first end having an incline relative to a centerline of the slip body, the slip body movable toward the downhole surface through interaction of the incline;

at least one insert unit disposed on the slip body, the at least one insert unit having a base and having one or more first inserts extending from the base, a first distal end of the one or more first inserts exposed at the second surface of the slip body and engageable with a load against the downhole surface, a first proximal end of the one or more first inserts disposed adjacent the base and defining a first surface area, the base disposed on the slip body at a base angle parallel to the incline of the slip body and defining a second surface area, the second surface area being greater than the first surface area and supporting the load of the one or more first inserts, wherein the base of the at least one insert unit comprises a bottom surface exposed at the incline of the first surface, whereby the base transmits the supported load directly and orthogonal to the incline.

22. A downhole apparatus for use adjacent a downhole surface, the apparatus comprising:

a slip body having first and second surfaces and having first and second ends, a portion of the first surface at the first end having an incline relative to a centerline of the slip body, the slip body movable toward the downhole surface through interaction of the incline; and at least one insert unit disposed on the slip body, the at least one insert unit having a base and having one or more first inserts extending from the base, a first distal end of the one or more first inserts exposed at the second surface of the slip body and engageable with a load against the downhole surface, a first proximal end of the one or more first inserts disposed adjacent the base and defining a first surface area, the base disposed on the slip body at a base angle relative to the centerline and defining a second surface area, the second surface area being greater than the first surface area and supporting the load of the one or more first inserts, wherein the one or more first inserts comprises at least two first inserts disposed side-by-side on the base and extending along axes parallel to one another or diverging from one another.

23. A downhole apparatus for use adjacent a downhole surface, the apparatus comprising:

a slip body having first and second surfaces and having first and second ends, a portion of the first surface at the first end having an incline relative to a centerline of the slip body, the slip body movable toward the downhole surface through interaction of the incline; and at least one insert unit disposed on the slip body, the at least one insert unit having a base and having one or more first inserts extending from the base, a first distal end of the one or more first inserts exposed at the second surface of the slip body and engageable with a load against the downhole surface, a first proximal end of the one or more first inserts disposed adjacent the base and defining a first surface area, the base disposed on the slip body at a base angle relative to the centerline and defining a second surface area, the second surface area being greater than the first surface area and supporting the load of the one or more first inserts, wherein the base of the at least one insert unit comprises a first side disposed across the first end of the slip body or disposed lengthwise on the slip body from the first end toward the second end; and wherein the one or more first inserts comprise at least two first inserts disposed side-by-side along the first side of the base.

* * * * *